US006610915B2

(12) United States Patent
Schleske

(10) Patent No.: US 6,610,915 B2
(45) Date of Patent: Aug. 26, 2003

(54) SOUNDBOARD OF COMPOSITE FIBRE MATERIAL CONSTRUCTION

(76) Inventor: Martin Schleske, Seitzstrasse 4, Munich (DE), 80538

( * ) Notice: Subject to any disclaimer, the term of this patent is extended or adjusted under 35 U.S.C. 154(b) by 0 days.

(21) Appl. No.: 09/935,972

(22) Filed: Aug. 23, 2001

(65) Prior Publication Data

US 2002/0066353 A1 Jun. 6, 2002

(30) Foreign Application Priority Data

Aug. 23, 2000 (DE) ..... 100 41 357

(51) Int. Cl.[7] ..... G10D 3/00
(52) U.S. Cl. ..... 84/291; 84/290; 84/267
(58) Field of Search ..... 84/291, 267, 290, 84/292

(56) References Cited

U.S. PATENT DOCUMENTS 4,348,933 A * 9/1982 Kaman et al. ..... 84/193
5,171,926 A * 12/1992 Besnainou et al. ..... 84/275
5,333,527 A * 8/1994 Janes et al. ..... 156/245
5,895,872 A 4/1999 Chase
5,905,219 A 5/1999 Westheimer

FOREIGN PATENT DOCUMENTS

DE 37 38 459 A1 5/1989
EP 0433 430 B1 2/1995

* cited by examiner

*Primary Examiner*—Kimberly Lockett
(74) *Attorney, Agent, or Firm*—John K. McCulloch

(57) ABSTRACT

A soundboard for use in acoustic musical instruments such as bowed stringed instruments in which the sound radiation takes place by means of resonant bodies. The soundboard has a body constructed as a composite fibre sandwich plate having a favourable ratio of stiffness to mass relative to conventional soundboards made from solid wood or composite which produces an increase in the sound radiation of the musical instrument. The area defined by the soundboard is enlarged relative to the average area of the soundboards of conventional musical instruments of the same type in such a way as to compensate for the characteristic frequency shifts and thus changes in timbre which result from the more favourable ratio of stiffness to mass of the composite fibre sandwich plate relative to the conventional solid wood soundboard.

13 Claims, 7 Drawing Sheets

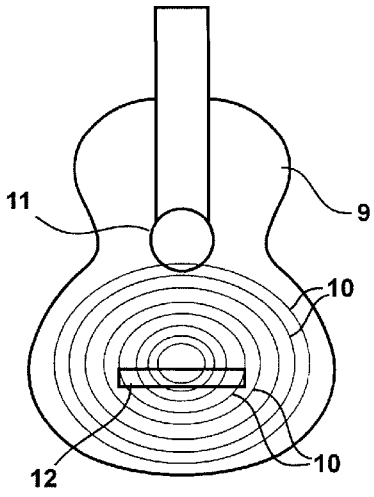
FIG - 9
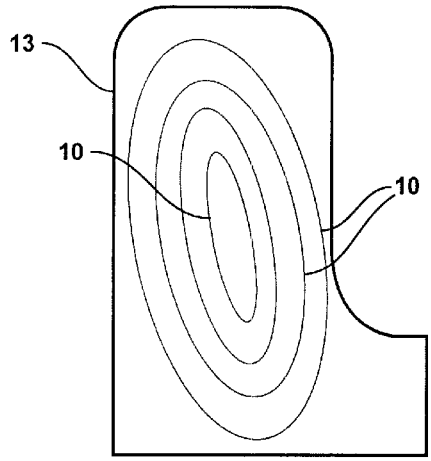
FIG - 10
FIG - 11
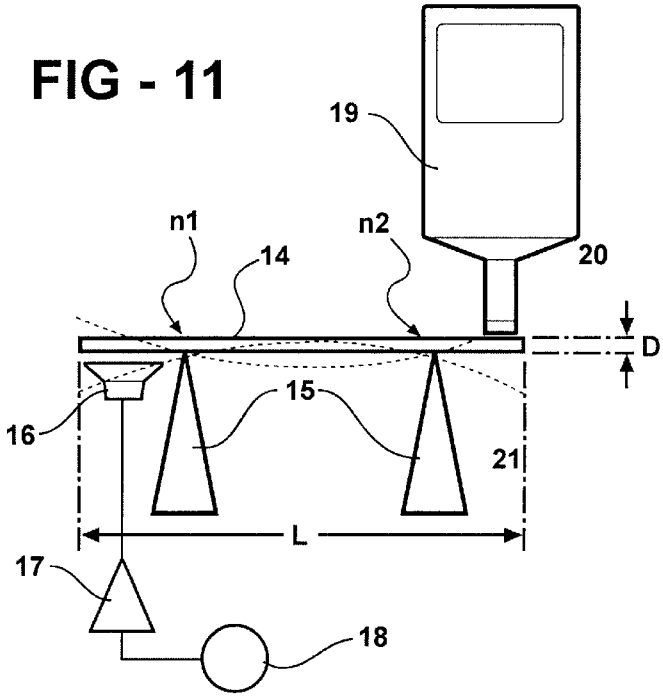

SOUNDBOARD OF COMPOSITE FIBRE MATERIAL CONSTRUCTION

BACKGROUND OF THE INVENTION

The invention relates to a soundboard of composite fibre material construction comprising at least one composite fibre laminate for use for an acoustic musical instrument, particularly a bowed stringed instrument.

The invention will be described in greater detail below using the example of the soundboards of bowed stringed instruments. However, it can also be used for other acoustic musical instruments (such as guitars and pianos) which are provided with a resonant body or resonant back-plate.

The resonant body of a bowed stringed instrument is formed by the two soundboards (top plate and back plate) and the ribs which connect them. The top plate is made in the traditional way from spruce, and the back plate is generally made from maple.

In recent years attempts have also been made to produce the soundboards of acoustic musical instruments in composite fibre material construction. Structures of composite fibre material construction generally consist of long fibres which are preferably oriented in certain directions and a carrier or matrix material which is generally a thermosetting or thermoplastic plastics material.

The previous efforts to produce soundboards of composite fibre material construction intended for acoustic musical instruments are aimed without exception at copying as well as possible the acoustic characteristics of the wood for which a composite fibre material is to be substituted. Examples of these attempts in the previously known prior art are provided for instance by DE 37 38 459 A1, EP 0 433 430 B1, U.S. Pat. Nos. 5,895,872 and 5,905,219. Thus DE 37 38 459 A1 aims at "a macroscopic heterogeneity almost equal to the wood" and states as the object that "the composite material" should "have similar characteristics to spruce".

An unsatisfactory feature of these previously known soundboards of composite fibre material construction appears to be that from the acoustic point of view they are equivalent to but in no way superior to very good solid wood soundboards of traditional construction.

The object of the invention, therefore, is to create a soundboard of composite fibre material construction which has a perceptibly better acoustic quality by comparison with excellent soundboards of traditional construction. In particular the soundboard according to the invention should have substantially higher radiated power whilst retaining the usual and desirable timbre of a solid wood soundboard.

This object is achieved according to the invention by the combination of the following features:

a) at least one test strip cut out of the soundboard has a quality quotient ($Q_M=c_L/\text{rho}$) of at least 0.02 $m^4/sg$, preferably at least 0.04 $m^4/sg$, where $c_L$ is the velocity of sound (in m/s) of the longitudinal waves in the longitudinal direction of the test strip and rho is the average total density (in $g/m^3$) of the test strip;

b) the area of the soundboard defined by the outline of the soundboard is chosen to be of such a size that b1) the frequency of the main body resonance (B1 mode) of bowed stringed instruments lies within the following ranges:

in the violin between 480 and 580 Hz, preferably between 510 and 550 Hz, in the viola between 380 and 500 Hz, preferably between 420 and 460 Hz, in the cello between 150 and 210 Hz, preferably between 170 and 190 Hz, in the double bass between 80 and 120 Hz, preferably between 90 and 110 Hz, b2) the frequency of the second-lowest body resonance (0,0 mode) in the guitar lies between 180 and 240 Hz, preferably between 190 and 220 Hz, b3) the frequency of the lowest resonance (0,0 mode) of the piano or grand piano soundboard lies between 40 and 60 Hz, preferably between 45 and 55 Hz.

SUMMARY OF THE INVENTION

In detail, the invention is based upon the following considerations and tests:

If a test strip is cut out of a soundboard (as will be explained in detail below in the description of an embodiment), then the acoustic quality of this test strip can be assessed using a quality quotient $Q_M$ which is defined as follows:

$$Q_M=c_L/rho$$

In this case $c_L$ is the velocity of sound (in m/s) of the longitudinal waves in the longitudinal direction of the test strip and rho is the average total density (in $g/m^3$) of the test strip.

Thus the quality quotient rises the greater the velocity of sound of the longitudinal waves is in relation to the vibrating mass. Thus a high value of $Q_M$ corresponds to a favourable ratio of stiffness to mass of the soundboard.

In the case of spruce wood $c_L$=5800 m/s and rho=400 $kg/m^3$ results in a typical quality quotient $Q_M$=0.0145 $m^4/sg$. In the tests on which the invention is based, the highest achievable value with resonant spruce wood was measured at $Q_M$=0.016 $m^4/sg$. This value corresponds to the values occurring in the soundboards of the most famous violin makers (such as Antonio Stradivari). Below-average resonant spruce wood lies at $Q_M$=0.012 $m^4/sg$.

By contrast, with test strips from soundboards of composite fibre material construction it is possible to establish quality quotients of more than 0.06 $m^4/sg$. Thus the acoustic material quality of soundboards of composite fibre material construction is almost four times as high as the acoustic material quality of the best resonant spruce wood which has aged over a long time. In spite of this well known fact, however, it has not been possible hitherto to create soundboards of composite fibre material construction which having regard to all necessary aspects are superior to the solid wood soundboards. The reasons for this difficulty and the sense of the combination of features according to the invention are apparent from the following considerations.

If a soundboard in composite fibre material construction is produced with the same geometric dimensions as a soundboard made of wood, then because of the substantially higher quality quotient $Q_M$ much higher characteristic frequencies (resonant frequencies) are produced. This rise in the characteristic frequencies leads to an undesirably sharp or nasal tone and thus changes the timbres of the instrument quite detrimentally.

It might then be thought that the excessively high characteristic frequencies of a soundboard of composite fibre material composition could be lowered (and shifted again in the direction of the characteristic frequencies of a conventional solid wood soundboard) by dimensioning the soundboard of composite fibre material construction so that it is thinner than a corresponding solid wood soundboard. However, in the tests on which the invention is based it was shown that the quality quotient $Q_M$ of a soundboard of composite fibre material construction—in total contrast to the quality quotient of a conventional solid wood soundboard—is dependent upon thickness, as a reduction in the board thickness in fact results simultaneously in a reduction in the quality quotient $Q_M$. Thus if the thickness of a soundboard of composite fibre material construction is reduced (in order to lower the resonant frequencies again into the desired range), then the quality quotient $Q_M$ is also reduced with it and thus the acoustic advantage which the composite fibre material construction has per se over the traditional wooden construction is lost.

With these considerations as a starting point, therefore, the invention follows a fundamentally different route in order to place the resonant frequencies of a soundboard of composite fibre material construction into the desired range which is usual for solid wood soundboards.

In the solution according to the invention, the raising of the characteristic frequency due to the composite fibre material construction (with which the very desirable increase in the quality quotient $Q_M$ is increased) is compensated for by such a geometry-induced lowering of the characteristic frequency by which the quality quotient $Q_M$ is not significantly lowered. According to the invention, for this purpose the area of the soundboard is of greater dimensions than in a soundboard made from solid wood for a bowed stringed instrument of the same timbre. An increase in area of the soundboard results in a shifting of the characteristic frequencies downwards. Because of its greater area the soundboard can then be given a greater thickness without the characteristic frequencies going above the necessary range for the desired and usual timbre. Thus the resulting quality quotient $Q_M$ lies markedly above that of a thinner plate which is not enlarged and is of composite fibre material construction.

Since an enlargement of the vibrating area simultaneously results in an increase in the sound radiation and thus an increase in the acoustic efficiency of the instrument, in the solution according to the invention not only is the desired timbre of the classical bowed stringed instruments achieved but also the additional tonal characteristics such as "projection", "volume" and "dynamics" are improved. Thus the soundboard according to the invention enables instruments to be built which correspond to the conventional instruments made from solid wood as regards the hearing habits (sensing the timbre) but which are markedly superior to the traditional instruments as regards their acoustic efficiency.

If in the case of a soundboard made from solid wood for a conventional bowed stringed instrument the area of the soundboards were to be enlarged, then this would shift the characteristic frequencies of the instrument so far downwards that a hollow ("dull") timbre would result. In a conventional bowed stringed instrument with solid wood soundboards, because of the low cross-stiffness of the solid wood boards a widening of the boards would also lead to the formation of modes of vibration with narrow parallel antiphase antinodes which result in a low sound radiation due to hydrodynamic short-circuits (cf. Cremer, Lothar: "Physik der Geige", Stuttgart 1981, page 341).

Therefore an increase in the area of the soundboard is only sensible when a material (such as a composite fibre material) is used which by comparison with wood has a higher bending strength and consequently a higher velocity of sound.

The acoustic condition formulated serves for controlling comparable timbres. The condition relates to the frequency of the main body resonance which—according to the relevant literature—is designated as B1 mode. The second lowest body resonance is referred to for the guitar and is designated as 0,0 mode. The lowest resonance of the soundboard of pianos or grand pianos, which according to its vibrational shape is likewise designated as 0,0 mode.

The said resonances, particularly the respective typical vibrational shape thereof, are explained in greater detail in relation to the embodiments described below.

In the tests on which the invention is based, modal analysis of outstanding instruments from famous violin makers (such as Antonio Stradivari or Guarneri del Gesu) were carried out in the inventor's acoustic laboratory. In violins of which the timbres are assessed by artists and trained listeners as pleasant and balanced the B1 mode always lies in a relatively narrow frequency band between 510 and 550 Hz. A violin with a B1 mode markedly above this frequency range tends to sound harsh and sharp, whereas a violin with a B1 mode below this frequency range tends to have a hollow and dull timbre. The characteristic frequency of the B1 mode can therefore be considered as a reliable acoustic indicator for the timbre of a bowed stringed instrument.

These and further details of the invention (for instance obtaining, measurement and evaluation of test strips) are explained in greater detail below with reference to the drawings.

THE DRAWINGS

Figure 1A:
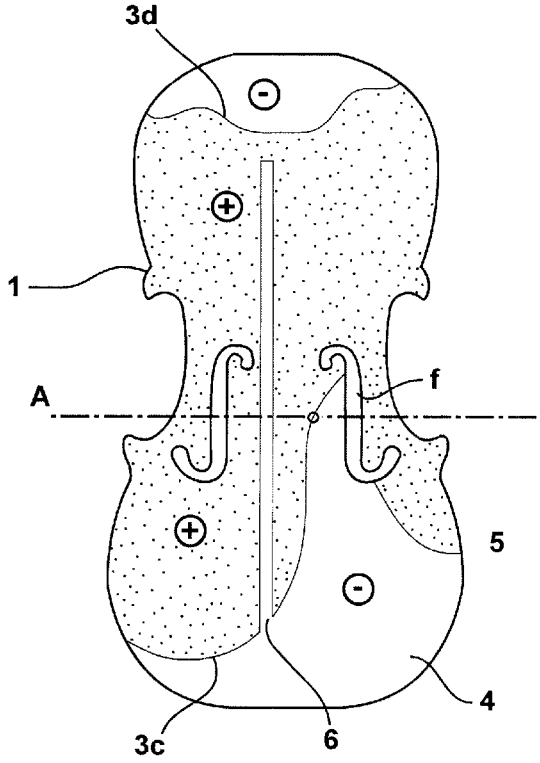
FIGS. 1A and 1B are plan views of the front and back plates, respectively, of a violin.
Figure 1B:
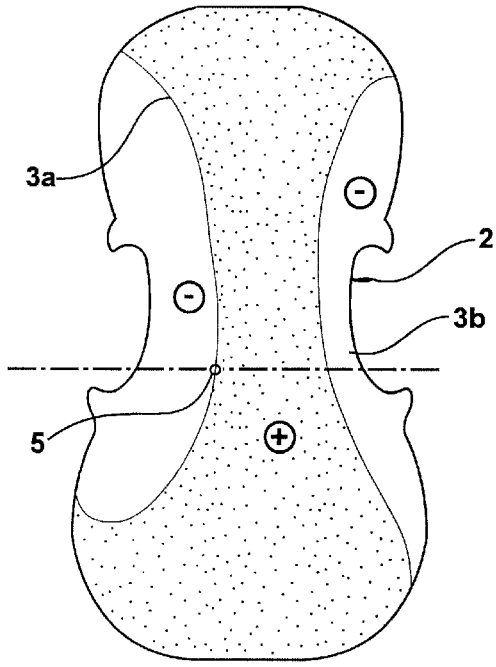
Figure 3A:
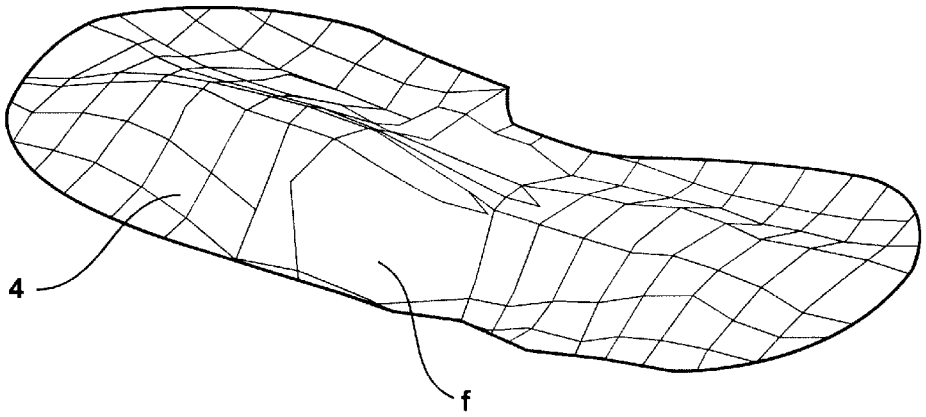
Figure 3B:
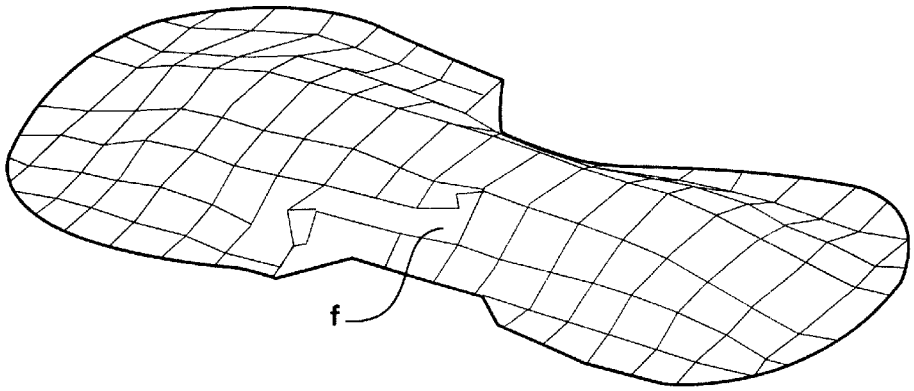
Figure 3C:
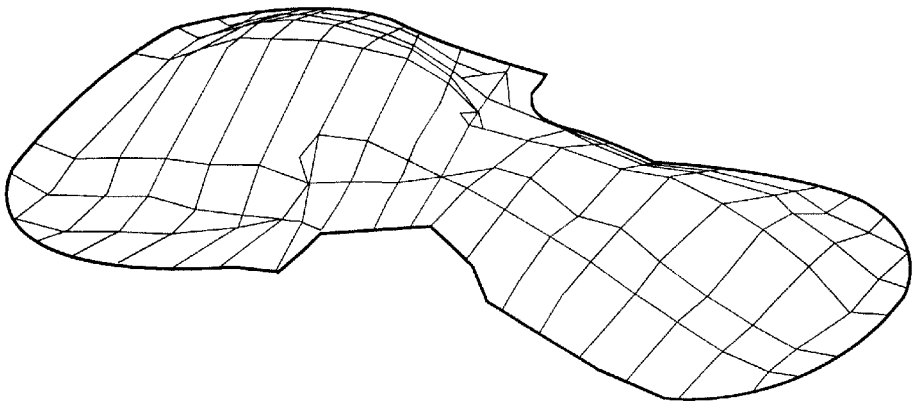
Figure 4A:
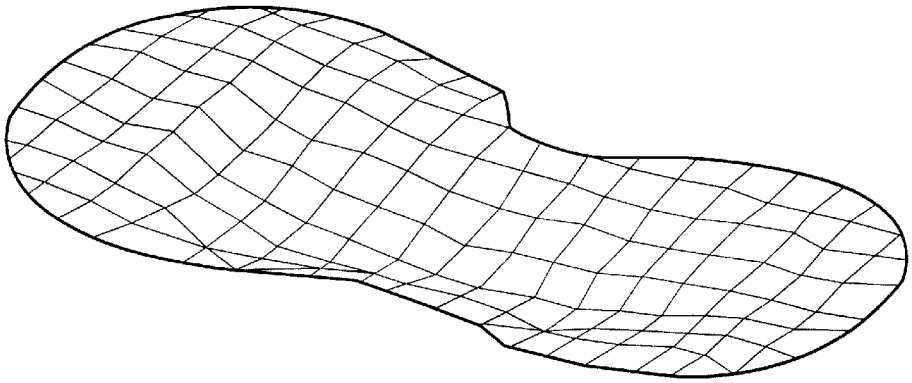
Figure 4B:
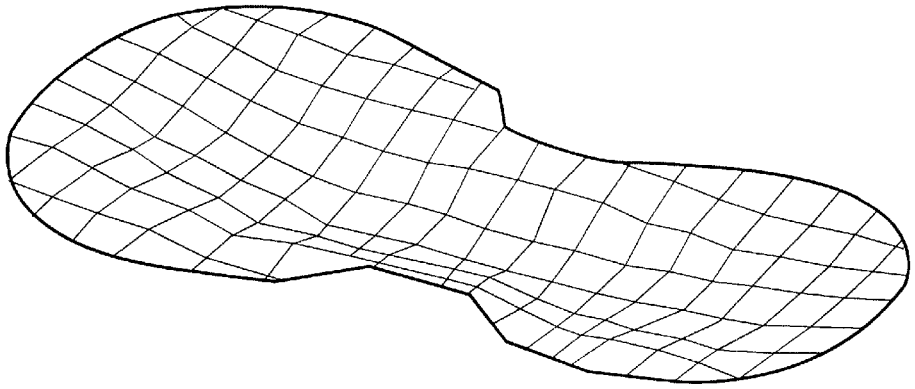
Figure 4C:
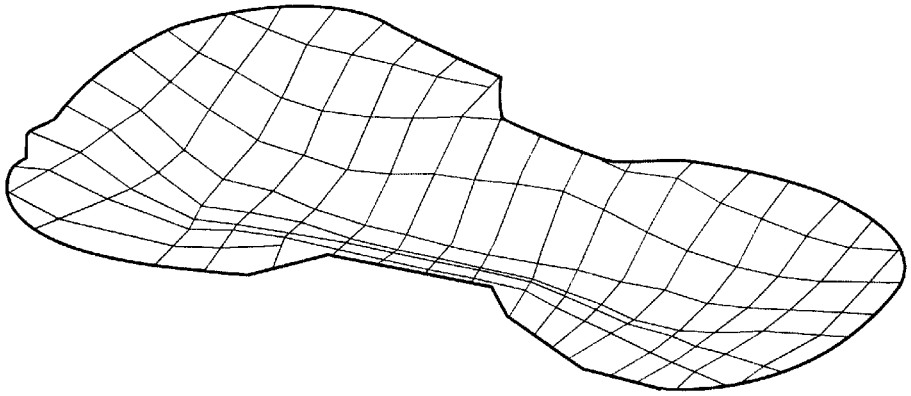
Figure 5:
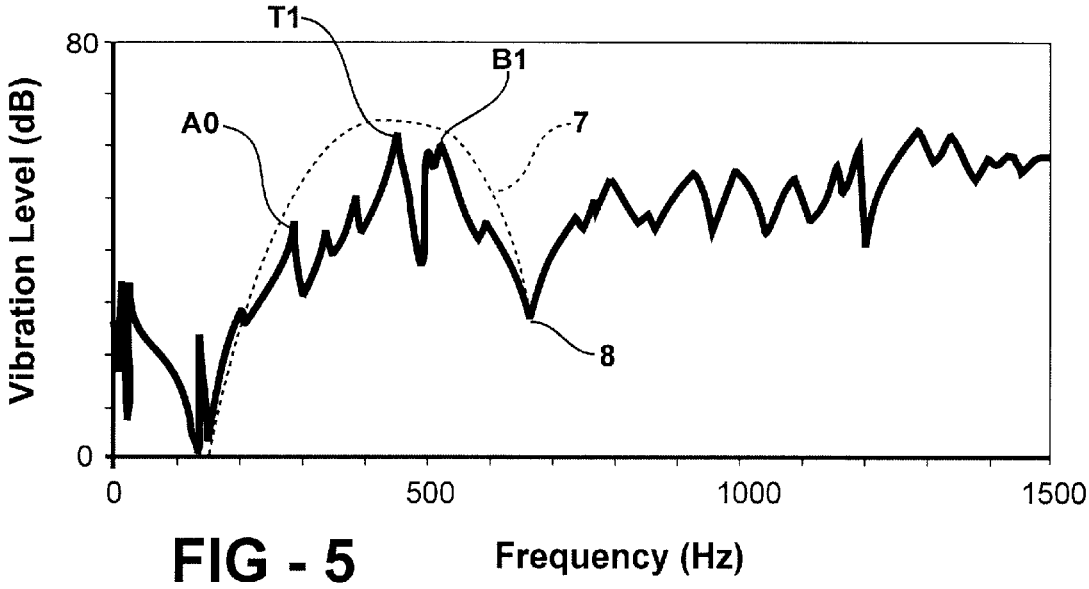
Figure 6:
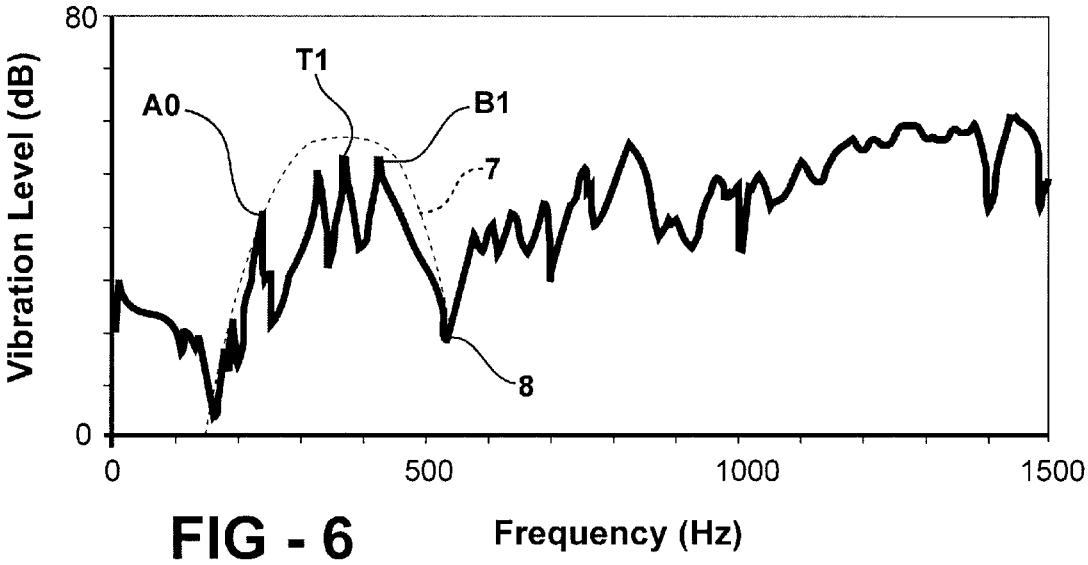
Figure 12:
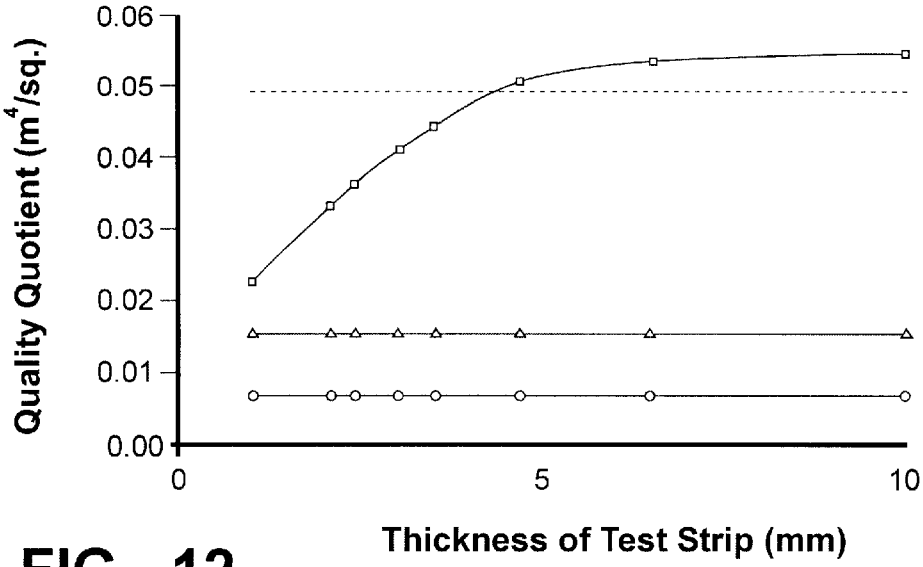
Figure 13:
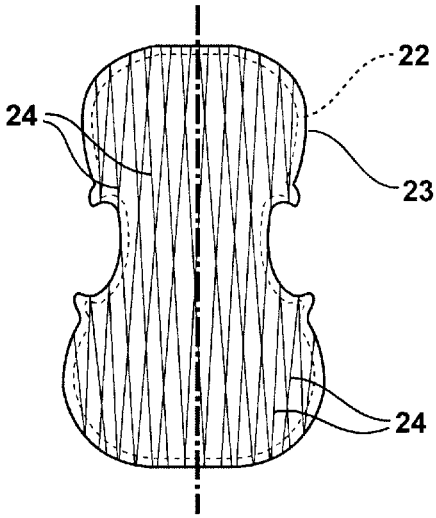
Figure 14:
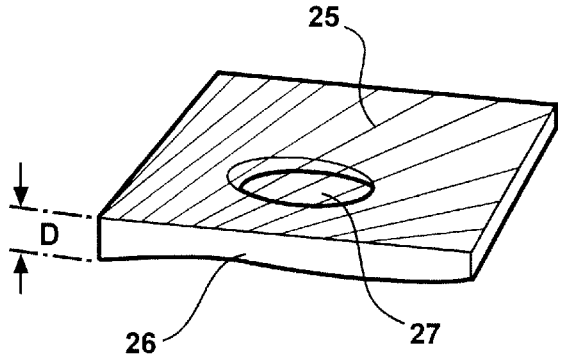

FIGS. 3A, 3B, and 3C illustrate the vibrational shape as wireframes of the B1 mode of the violin top plate shown in FIG. 1A;

FIGS. 4A, 4B, and 4C illustrate the vibrational shape as wireframes of the B1 mode of the violin back plate shown in FIG. 1B;

FIGS. 5–8 illustrate, respectively, the input accelerance of a violin, a viola, a cello, and a bass;

FIG. 9 illustrates the second-lowest body resonance of an acoustic guitar;

FIG. 10 illustrates the second-lowest body resonance of the soundboard of a piano or grand piano;

FIG. 11 is a diagrammic representation of a measuring device for determining the velocity of sound of the longitudinal waves in the longitudinal direction of a test strip;

FIG. 12 illustrates the correlation between the thickness of a test strip and the quality quotient;

FIG. 13 is a plan view of a violin back plate showing in full lines an increase in the area of the soundboard over that shown in dash lines; and FIG. 14 is an isometric view of a segment of a soundboard having variations in its thickness.

DETAILED DESCRIPTION

FIGS. 1 to 4 show the typical characteristic vibrational shape of the main body resonance (B1 mode) as it occurs in violins, violas, cellos and double basses. In parts of the literature the B1 mode is also called C3 mode (Jansson) or $B1_+$ mode (Hutchins). The mode is measured with the aid of experimental modal analysis. In the experimental modal analysis a plurality of transfer functions (acceleration divided by force; or vibration response divided by vibration excitation) are measured as the instrument is excited by means of a little impact hammer (e.g. PCB 086C80) at a plurality of co-ordinates distributed over the body. The vibration response is measured by means of an accelerometer (e.g. (PCB 352B22) at the so-called driving point. The upper end of the side edge (bass bar side) of the bridge is chosen as driving point. All these measurements are carried out in the final setup of the instrument, the strings merely being damped by means of foam material in such a way that the sharp string resonances are damped whilst the body resonances of the instrument which are to be determined are not changed. Apart from the piano and the grand piano, which are measured in their normal standing position, the measurement of the other musical instruments in which the soundboard according to the invention is installed is carried out with free-free support. For this purpose the instruments are advantageously gently supported in the region of the upper and lower end blocks on foam cushions. The transfer functions are evaluated by means of the relevant programs (e.g. STAR Structure) in the usual way for the modal analysis.

Figure 2:
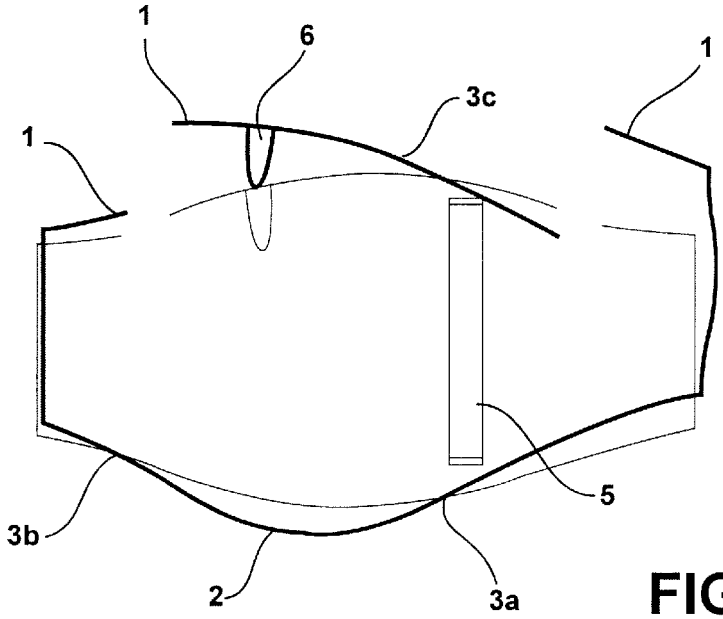
FIG. 2 is a cross-section through the body of a violin taken on the line A of FIGS. 1A and 1B.

The B1 mode of a violin is shown in FIGS. 1A and 1B by means of a contour plot wherein FIG. 1A represents the top plate 1 and FIG. 1B represents the back plate 2—each as viewed from the exterior. The measurement takes place in the assembled final setup of the instrument. The strippled surface areas designated by "+" vibrate in antiphase to the white surface areas designated by "−", whereby the strippled areas of the back plate swing outwards (in the direction of the exterior of the body) and after half a period of motion they swing inwards. The same applies correspondingly to the white areas (non strippled) areas of bothe plates. This phase relation is illustrated in FIG. 2 using grossly exaggerated amplitudes (thick lines); it shows a cross-section through the body on the line denoted by A in FIG. 1. For orientation purposes the thin lines reproduce the equilibrium position of the body. The details of the distribution of amplitudes can vary from instrument to instrument; however, the following features are always typical for the characteristic vibrational shape of the B1 mode:

- two nodal lines 3*a* and 3*b* extend in the longitudinal region of the back plate 2, the left-hand nodal line 3*a* extending through the area of the soundpost 5. Thus the central area of the back plate 2 vibrates in antiphase to its two lateral edges. This cross-bending vibration of the back plate is characteristic for the B1 mode. In a few instruments it may be observed that the two nodal lines 3*a* and 3*b* merge like an arc in the upper region of the back plate 2.
- the lower right cheek 4 (shown in white) of the top plate 1 vibrates in antiphase to the antinode (shown in black) including the greater part of the top plate surface in the region of the bass bar 6, whereby the nodal line 3*c* which separates these antiphase antinodes extends as a rule through the immediate vicinity of the soundpost 5 and then through the right-hand f-hole (designated by "f") in order to leave the outline of the top plate in the region of the greatest width of the outline at the bottom right.

To improve understanding, FIG. 3 (top plate) and FIG. 4 (back plate) show the characteristic vibrational shape of the B1 mode, but this time (in contrast to the contour plot of FIG. 1) as wireframes, wherein FIGS. 3*a* and 4*a* show the position deflected by −90° and FIGS. 3*c* and 4*c* show the position deflected by +90° relative to the rest position shown in FIGS. 3*b* and 4*b*.

Figure 7:
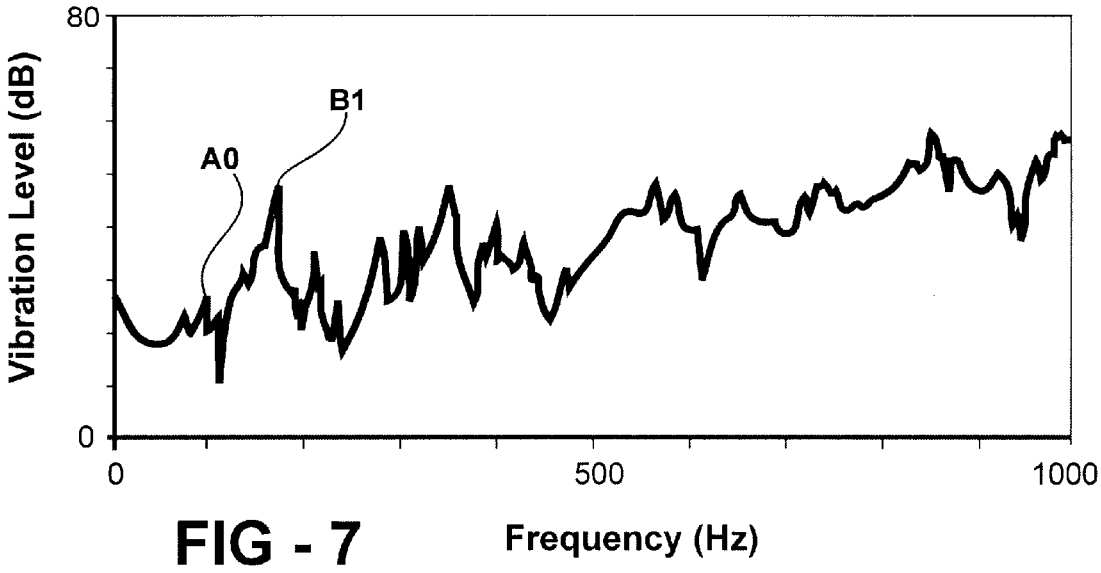
Figure 8:
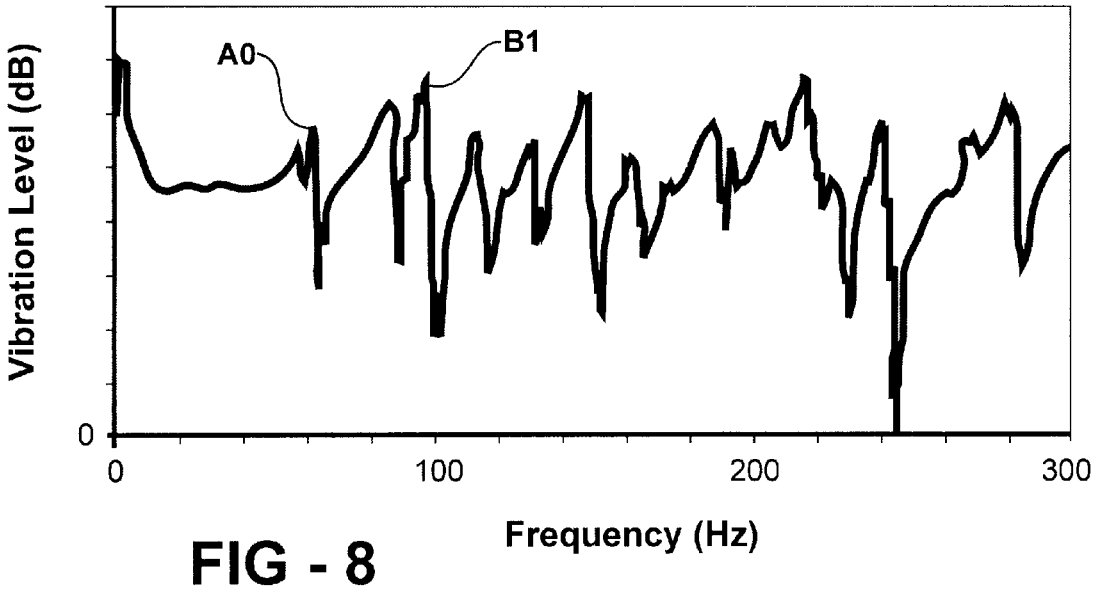

The frequency responses shown in FIGS. 5 to 8 represent the typical input acceleranrce of a violin (FIG. 5), a viola (FIG. 6), a cello (FIG. 7) and a double bass (FIG. 8). The input accelerance is the transfer function at which the vibration excitation and the vibration response are measured at the same measurement point. The aforementioned driving point is chosen as the measurement point. The X-axis of the input accelerance relates to the frequency, the Y-axis relates to the vibration level (acceleration divided by exciting force) in dB. The different resonances can be clearly recognised as single peaks. In the violin and the viola (FIGS. 5 and 6) the B1 mode typically forms the last projecting resonance peak of the frequency region of the body resonances formed by the envelope 7. This resonance frequency region is always separated by a sharp incision (antiresonance) from the higher-frequency plate resonance peaks. As can be seen in FIG. 7, in the cello the B1 mode as a rule forms the highest low-frequency resonance peak below 300 Hz. In the cello the B1 mode can often also be determined without physical methods of measurement by the so-called wolf note delicacy of the bowed note (particularly on the C string) of which the fundamental frequency corresponds to the resonant frequency of the B1 mode.

In the double bass (FIG. 8) the B1 mode lies as a rule as the second main body resonance following the Helmholtz resonance Ao in the range around 100 Hz. The resonance peaks of the Helmholtz resonance Ao and of the T1 mode which lies below the B1 mode are characterised as such in FIGS. 4 to 7.

The second-lowest body resonance of the acoustic guitar is illustrated in FIG. 9. This resonance is designated in the literature [see Fletcher N. H. and Rossing T. D.: "The Physics of Musical Instruments", New York 1991] as a mode with 0,0 character since it does not have nodal lines in the longitudinal direction or the cross direction of the top plate 9, but rather it is characterised by a single antinode for each soundboard (top plate and back plate). In the guitar the combination of air cavity, top plate and back plate leads to three body resonances with 0,0 characteristic, namely to the Helmholtz resonance and to two body resonances which are closely adjacent in frequency terms and lie approximately 100 Hz above the Helmholtz resonance. This mode is the lower-frequency one of these two last-mentioned resonances and, since the Helmholtz resonance is the first body mode of the guitar, this is the second-lowest body resonance, or the middle one of the three body resonances with 0,0 character. It differs from the higher-frequency third body resonance with 0,0 characteristic by the phase relation between the top plate and the back plate. In the second-lowest body resonance the top plate and back plate vibrate in phase (in the same spatial direction), so that the body deforms as a whole like a thick plate; on the other hand, in the higher-frequency third 0,0 body mode the top plate and the back plate vibrate in antiphase, that is to say they carry out a "breathing" movement of the body. The vibrational shape of the mode is illustrated in FIG. 9 by lines of equal amplitudes 10. These are centred around the region of the bridge 12 and describe an antinode which assumes approximately the shape of the lower area of the outline of the soundboard [cf.Richardson, B. E. "The acoustical development of the guitar" in: Catgut Acoust. Soc. J. Vol. 2, No. 5 (Series II) May 1994; page 5; FIG. 4b].

The lowest resonance of the soundboard of the piano or grand piano is also designated as 0,0 mode according to its vibrational shape. Its vibrational shape is shown in FIG. 10 by lines of equal amplitudes 10 [cf. Kindel: "Modal analysis and finite element analysis of a piano soundboard" M.S.

thesis, University of Cincinnati, quoted from Fletcher N. H. and Rossing T. D.: "The Physics of Musical Instruments", New York 1998, page 382].

The ascertainment and measurement of the quality quotient $Q_M$ are advantageously carried out as follows:

Strip elements 14 are cut out of selected areas or zones of the soundboard. The proportions of a strip element are derived as follows from the average thickness ($D_m$) of the strip element: The length L of the strip corresponds to 25 times the thickness $D_m$ the width B of the strip corresponds to 5 times the thickness $D_m$.

Then the velocity of sound $C_L$ of the longitudinal waves in the longitudinal direction of the strip element (strip) is determined using known measuring techniques. For this measurement the vibration exciting method established in the field of measurement of structure-borne sound is used. This is illustrated in FIG. 11:

The strip 14 is resiliently mounted on rubber members or foam wedges 15 in the two nodal lines ($n_1$ and $n_2$) of the characteristics frequency of its first bending mode (free-free boundary conditions). The strip is excited sinusoidally via sound waves in air. For this purpose a miniature loudspeaker 16 which is connected to a power amplifier 17 is positioned at a distance of approximately 5 mm below one of the two ends of the strip. The sinusoidal signal is generated by a sine wave generator 18. The vibration response of the strip which is excited sinusoidally in this way is picked up with the aid of a sound level meter 19. For this the microphone 20 of the sound level meter is positioned at a distance of approximately 1 mm above the end of the strip which lies opposite the loudspeaker. At the sine wave generator 18 the frequency is gradually increased until the characteristic frequency of the strip can be read off through the appertaining maximum level of the level peak on the sound level meter. (The slight characteristic frequency deviation due to the damping can be ignored at this point). The frequency $f_{2;0}$ (in Hz) which corresponds to the maximum level of this resonance peak is noted. (Meaning of the indication $f_{n;m}$: number of nodal lines extending in the cross direction of the strip n=2; number of nodal lines in the longitudinal direction m=0; the corresponding characteristic vibrational shape is symbolised by means of the (broken) lines of maximum deflection 21 in FIG. 11).

The velocity of sound ($c_L$) of the longitudinal waves (in m/s) is defined as follows:

$$c_L=(0.98*f_{2;0}*L^2)/D_m$$

where L is the strip length (in m), $D_m$ is the average strip thickness (in m), and $f_{2;0}$ is the reasonant frequency (in Hz). (So long at the strip thickness is not constant, an average is taken of the different thicknesses and an average strip thickness $D_m$ is set.)

The average total density rho of the strip is calculated from rho=m/V, where m is the total mass (in g) and V is the total volume (in $m^3$) of the strip. The total volume V is determined by measuring the strip dimensions (strip length L (in m), strip width B (in m) and the average strip thickness $D_m$ (in m)) according to $V=L*B*D_m$.

The physically essential correlation between the thickness and the quality quotient $Q_M$ upon which the invention is based is shown in FIG. 12: The strip thickness $D_m$ (in mm) is plotted on the X-axis and the quality quotient $Q_M$ (in $m^4$/sg) is plotted on the Y-axis. The curves designated by A (maple) and F (spruce) represent the quality quotient of the types of wood conventionally used for soundboards. This shows that the quality quotient is independent of the thickness and in this series of tests it was 0.0155 $m^4$/sg for spruce and 0.0067 $m^4$/sg for maple.

The curve designated by VS shows the quality quotient $Q_M$ for the test strips of the soundboard according to the invention produced as a composite fibre sandwich. The deterioration of this quotient $Q_M$ as the strip thicknesses are reduced below 4 mm is clearly recognisable. Depending upon the nature of the material of the core plate and of the composite fibre material (weight per unit area of the fibres; resin content, etc.), and also depending upon the core plate recesses and composite fibre laminate (direction and density), different curves Vs are obtained, i.e. different dependences of the quality quotient $Q_M$ upon the plate thickness. The thickness of the soundboard is dimensioned so that the quality quotient $Q_M$ of at least one test strip cut out of the soundboard is at least 90% of the maximum value which can be attained with the chosen composite fibre material. This 90% line 28 is shown in FIG. 12 for the composite fibre material which is used there.

The function VS in FIG. 12 makes it clear immediately that compensation for rises in the characteristic frequency of the soundboard by reducing its thickness leads to a deterioration in the acoustic quality. By contrast, according to the invention the tonally necessary lowering of the characteristic frequency is achieved by enlarging the area defined by the outline of the soundboard. FIGS. 13 and 14 show an embodiment of this. Since the width of the soundboard in first approximation goes in square into the characteristic frequencies, a relatively small widening of the outline 23 of the soundboard according to the invention which is constructed with a composite fibre laminate 24 by approximately 5% relative to the conventional outline 22 (shown by broken lines) can already provide the required frequency shift.

As shown on a segment in FIG. 14, the core plate 26 of the soundboard has recesses 27, the total volume of all recesses amounting at most to 80%, preferably between 20 and 45%, of the total volume of the core plate filled with material. This feature allows an improvement in the ratio of stiffness to mass. The segment of the soundboard shown in FIG. 14 has a variable thickness D. It has a multidirectional fibre laminate which consists of fibres 25 which are not disposed parallel.

Key to Drawings

Frequenz=frequency

Materialqualität=material quality

Dicke des Teststreifens=thickness of test strip

What is claimed is:

1. A soundboard for an acoustic musical instument, said soundboard comprising a composite body composed of elongate fibers in a carrier, at least one zone of said body having a quality quotient ($Q_M=c_L$/rho) of at least 0.02 $m^4$/sg where $c_L$ is the velocity of sound (in m/s) of waves longitudinally of said zone and rho is the average total density of said zone.

2. The soundboard according to claim 1 wherein said soundboard has an area for a violin such that its main body resonance is betweenn about 480 and 580 Hz.

3. The soundboard according to claim 1 wherein said soundboard has an area for a viola such that its main body resonance is between about 380 and 500 Hz.

4. The soundboard according to claim 1 wherein said soundboard has an area for a cello such that its main body resonance is between about 150 and 210 Hz.

5. The soundboard according to claim 1 wherein said soundboard has an area for a double bass between about 80 and 120 Hz.

6. The soundboard according to claim 2 wherein the area of said soundboard is such that the main body resonance is between about 510 and 550 Hz.

7. The soundboard according to claim 3 wherein the area of said soundboard is such that the main body resonance is between about 420 and 460 Hz.

8. The soundboard according to claim 4 wherein the area of said soundboard is such that the main body resonance is between about 170 and 190 Hz.

9. The soundboard according to claim 5 wherein the area of said sooundboard is such that the main body resonance is between about 90 and 110 Hz.

10. The soundboard according to claim 1 wherein said body has an area such that in a guitar its second-lowest body resonance frequency is between about 180 and 240 Hz.

11. The soundboard according to claim 1 wherein said body has an area such that in a piano its lower body resonance frequency is between about 40 and 60 Hz.

12. The soundboard according to claim 11 wherein said lower resonance frequency is between about 45 and 55 Hz.

13. The soundboard according to claim 1 wherein the value of said quality quotient is at least 90° of the maximum attainable.

* * * * *